US011065501B2

(12) United States Patent
Snover

(10) Patent No.: US 11,065,501 B2
(45) Date of Patent: Jul. 20, 2021

(54) SINGLE-ARM WORKOUT BODY CONDITIONING MACHINE

(71) Applicant: Ramon Snover, San Clemente, CA (US)

(72) Inventor: Ramon Snover, San Clemente, CA (US)

( * ) Notice: Subject to any disclaimer, the term of this patent is extended or adjusted under 35 U.S.C. 154(b) by 59 days.

(21) Appl. No.: 16/692,875

(22) Filed: Nov. 22, 2019

(65) Prior Publication Data

US 2020/0164246 A1 May 28, 2020

Related U.S. Application Data

(60) Provisional application No. 62/770,930, filed on Nov. 23, 2018.

(51) Int. Cl.
*A63B 21/22* (2006.01)
*A63B 21/008* (2006.01)
(Continued)

(52) U.S. Cl.
CPC ..... *A63B 21/22* (2013.01); *A63B 21/00061* (2013.01); *A63B 21/0088* (2013.01); *A63B 21/0615* (2013.01); *A63B 21/078* (2013.01); *A63B 23/12* (2013.01); *A63B 24/0062* (2013.01); *A63B 21/153* (2013.01);
(Continued)

(58) Field of Classification Search
CPC ..... A63B 23/035; A63B 23/03508; A63B 23/03516; A63B 23/0355; A63B 23/0405; A63B 2023/0411; A63B 21/0615; A63B 21/0617; A63B 21/00058; A63B 21/00069; A63B 21/00072; A63B 21/02; A63B 21/022; A63B 21/04; A63B 21/0407; A63B 21/0421; A63B 21/0435; A63B 21/0442; A63B 21/055; A63B 21/0552; A63B 21/0616; A63B 21/078; A63B 21/15; A63B 21/151; A63B 21/159; A63B 21/22;
(Continued)

(56) References Cited

U.S. PATENT DOCUMENTS 4,511,137 A * 4/1985 Jones ..... A63B 21/00181 482/100
4,711,448 A * 12/1987 Minkow ..... A63B 21/00072 482/100

(Continued)

*Primary Examiner* — Garrett K Atkinson
*Assistant Examiner* — Zachary T Moore
(74) *Attorney, Agent, or Firm* — Andrew S. Dallmann, P.C.

(57) ABSTRACT

An exercise machine allows a user to perform a variety of resistance exercises with adjustable resistance levels. The machine is made up of an arm, a user platform, a horizontal base, an adjustable counterweight arrangement, a pull rod, a drive chain system, sprockets, shafts, adjustable fan, a slip bearing, a recoiler, a plurality of wheels, a drive chain system housing, a user back support, a user cable grip, and a circuit-breaking sensitive rubber mat. When the arm is moved upwards (by a user) the pull rod attached to a drive chain initiates the drive chain system rotation. The drive chain system rotation includes an adjustable weight fan that creates resistance to the arm's upper movement through inertia. The adjustable counterweight arrangement determines the arm drop speed and the arrangement has multiple positions. Other variants include a plurality of electronic encoders.

20 Claims, 5 Drawing Sheets

(51) Int. Cl.

| | |
|---|---|
| ***A63B 23/12*** | (2006.01) |
| ***A63B 21/06*** | (2006.01) |
| ***A63B 21/078*** | (2006.01) |
| ***A63B 23/035*** | (2006.01) |
| ***A63B 21/00*** | (2006.01) |
| ***A63B 24/00*** | (2006.01) |

(52) U.S. Cl.
CPC ..... *A63B 21/4037* (2015.10); *A63B 23/03508* (2013.01); *A63B 2220/58* (2013.01); *A63B 2220/833* (2013.01)

(58) Field of Classification Search
CPC ..... A63B 21/4041; A63B 21/4045; A63B 21/4047; A63B 21/4049
See application file for complete search history.

(56) References Cited

U.S. PATENT DOCUMENTS 5,795,270 A * 8/1998 Woods ..... A63B 21/0088 482/62
6,482,128 B1 * 11/2002 Michalow ..... A63B 69/0028 482/100
7,029,426 B1 * 4/2006 Fuller, Sr. ..... A63B 21/0615 482/137
7,527,568 B2 * 5/2009 Joseph ..... A63B 69/345 473/422
8,876,665 B1 * 11/2014 Isom ..... A63B 21/4003 482/10

* cited by examiner

SINGLE-ARM WORKOUT BODY CONDITIONING MACHINE

RELATED APPLICATION

This application claims priority to U.S. Provisional Patent Application Ser. No. 62/770,930 for an "Iso-Plyo Workout Body Conditioning Machine," filed Nov. 23, 2018, and currently co-pending, the entirety of which is incorporated herein by reference.

FIELD OF THE INVENTION

The present invention generally pertains to exercise machines. More specifically, the present invention relates to isometric and plyometric body conditioning machines. The invention is particularly, but not exclusively, useful as a training machine with the ability to do explosive exercise with safety mechanisms.

BACKGROUND OF THE INVENTION

Isometric exercise is a style of training involving the static contraction of a muscle without any visible movement in the angle of the joint. During such activities, the joint angle and the length of the associated muscle do not change during contraction. Isometric exercise has a tendency to be inertia free. The risk of physical injury to the individual tends to be substantially mitigated thereby making such exercises more suitable for rehabilitative applications.

Plyometrics are exercises in which muscles exert maximum force in short intervals of time, intending to increase power. This training focuses on learning to move from a muscle extension to a contraction in a rapid or "explosive" manner, such as in specialized repeated jumping. Plyometrics are primarily used by athletes, especially martial artists, sprinters, and high jumpers, to improve performance, and are used in the fitness field to a much lesser degree.

Most exercise machines and apparatuses constructed over the years are tailored for compound exercises. Along similar lines, plyometric exercise structures and apparatuses created for explosive exercises targeting compound muscle groups and often do not have safety mechanisms. Based on the preceding, there is a real need for exercise equipment specifically designed for combination isokinetic and plyometric exercise.

In light of the foregoing, it would be advantageous to have an isokinetic and plyometric exercise apparatus providing features for creating different types of resistance and exercise to provide the user with the option to perform a variety of exercises at various levels of resistance.

SUMMARY OF THE INVENTION

Disclosed is an isokinetic and plyometric exercise apparatus that provides an adjustable weight resistance fan, counterweight system for implementing various speeds of plyometric exercise, a recoil device that can increase the speed of plyometric training, and an on-off function for switching between isokinetic and plyometric exercise. Preferably, such an apparatus could be configured to create different types of resistances and exercise, thereby offering the exercising individual the option to perform a variety of exercises at various levels of resistance.

A preferred embodiment is an exercise machine that allows a user to perform a variety of resistance exercises with adjustable resistance levels. Preferred embodiments of the machine have components including an arm, a user platform, a horizontal base, an adjustable counterweight arrangement, a pull rod, a drive chain system, sprockets, shafts, adjustable fan, a slip bearing, a recoiler, a plurality of wheels, a drive chain system housing, a user back support, a user cable grip, and a circuit-breaking sensitive rubber mat.

The user uses the machine to perform resistance exercises to strengthen muscle and connective tissue, develop speed, quicken reaction time, and cardiovascular conditioning. When the arms are moved upwards (by a user), the pull rod attached to a drive chain initiates the drive chain system rotation. The drive chain system rotation includes an adjustable weight fan that creates resistance to the arm's upward movement through inertia. The adjustable counterweight arrangement determines the arm drop speed, and the arrangement has multiple positions.

During the operation of the arm, the recoiler allows for the quick return of the arm to its rest position. The recoiler device includes a housed spring and cable attachment and is designed for automatic arm return.

In some embodiments, the machine includes electronic encoders that collect force resistance data at certain critical locations of the machine. The electronic encoders are connected to an electronic user monitor readout that the user can display how much resistance the machine is applying and other adjustable settings of the machine.

In other embodiments, the machine includes an On-Off function that disengages the adjustable fan from spinning when the arm is lifted. The On-Off device is attached to a sprocket that allows the sprocket to freewheel without the fan or engage the fan. The On-Off device features the drive train that rotates the fan and male and female assemblies.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
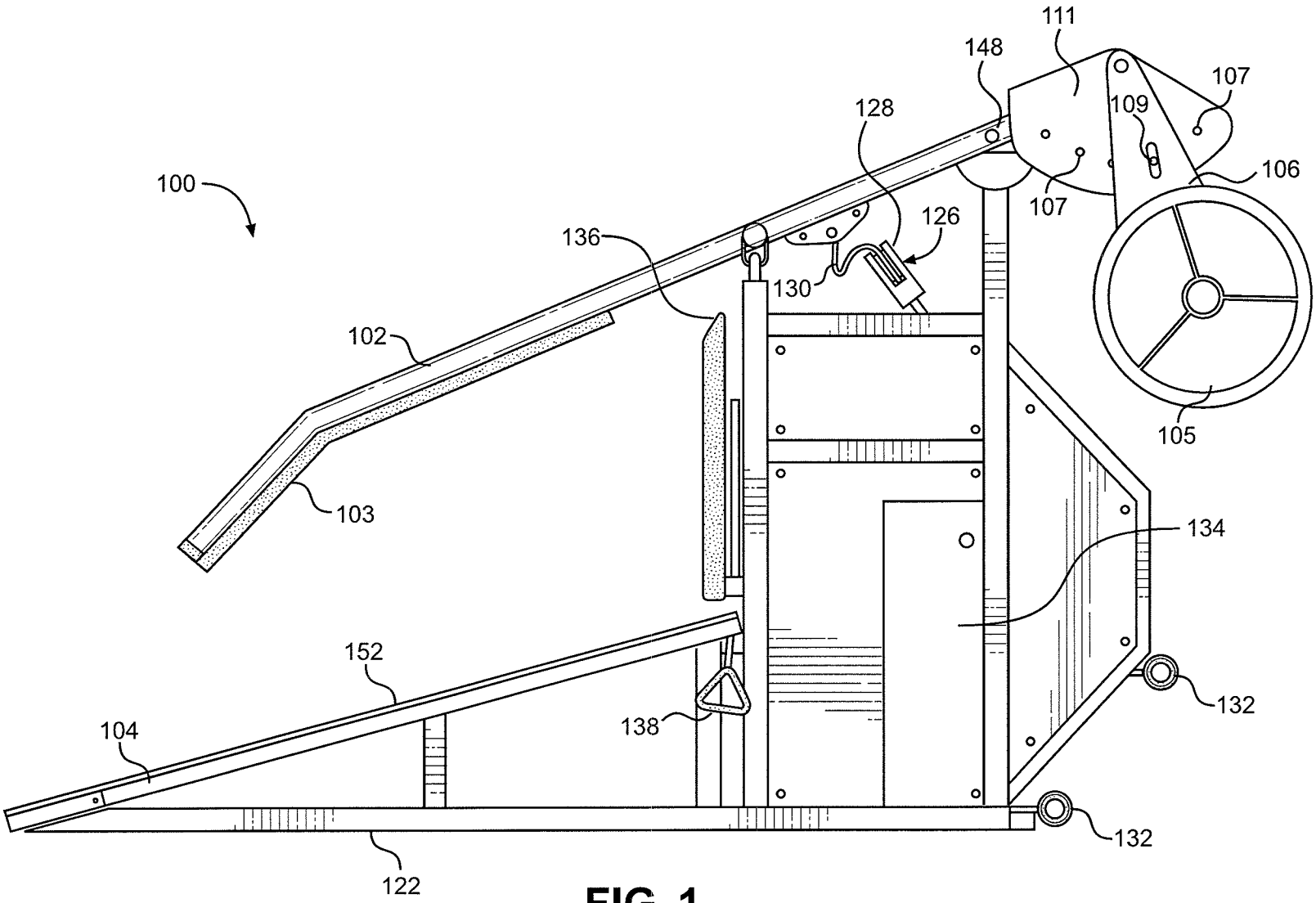
FIG. 1 is a front view of the exterior of a preferred embodiment of a single-arm workout body conditioning machine including an arm, an adjustable counterweight arrangement, horizontal base, and a user platform.

Referring now to FIG. 1, an exercise machine which allows a user to perform a variety of resistance exercises with adjustable resistance levels according to several embodiments of the present invention is shown and generally designated 100. Machine 100 includes a padded arm 102. The padded arm 102 is connected to a pull rod 108 (shown in FIG. 2), a recoiler 126, and an adjustable counterweight arrangement 106. The recoiler 126 can consist of a housed spring 128 and cable attachment 130 and is manufactured for automatic arm return.

When a user applies an upward force to the arm 102 from the rest position of arm 102, the connected pull rod 108 and recoiler 126 move upward. During the same motion, on the opposite side of the arm's pivot point 148, the adjustable counterweight arrangement 106 moves downward.

Upon removal of the upward applied force to the arm 102, the recoiler 126 and pull rod 108 exert an inertial force to return the arm 102 to its rest position. Depending on the desired return speed of arm 102, the user can make adjustments to the position of the adjustable counterweight arrangement 106 using the counterweight positional selectors 107. These selectors 107 can determine if the arm 102 drops fast (heavier) or slow (lighter). The function of the counterweight arrangement 106 is to determine the force of the arm 102 when the arm 102 drops on its downward return to the rest position from its fully extended position. In preferred embodiments, the positional selectors 107 are apertures, such as pinholes, and the counterweight arrangement 106 is held in place by a removable pin 109.

Some embodiments of the counterweight arrangement 106 include at least three optional positional selectors 107. When the adjustable counterweight 106 is positioned toward the back, furthest from the front of the arm 102, the arm 102 is balanced to be lighter in weight at the user pad 103. This position reduces the downward force of the arm 102 so the decline downward is slower and easier for the user to control.

In an embodiment with three positional selectors, a second position for the adjustable counterweight 106 is a middle positional selector. This position makes the downward force of the arm 102 at the user pad 103 or handle end adjustable. In this position, the load and speed of the return drop of the arm 102 can be finely adjusted with a weights or weights 105.

In the last position, the adjustable counterweight 106 can be positioned forward, toward the arm 102. This position makes the downward force of the arm 102 at the user pad 103 or handle end heavier, resulting in a faster return drop of the arm 102.

Figure 2:
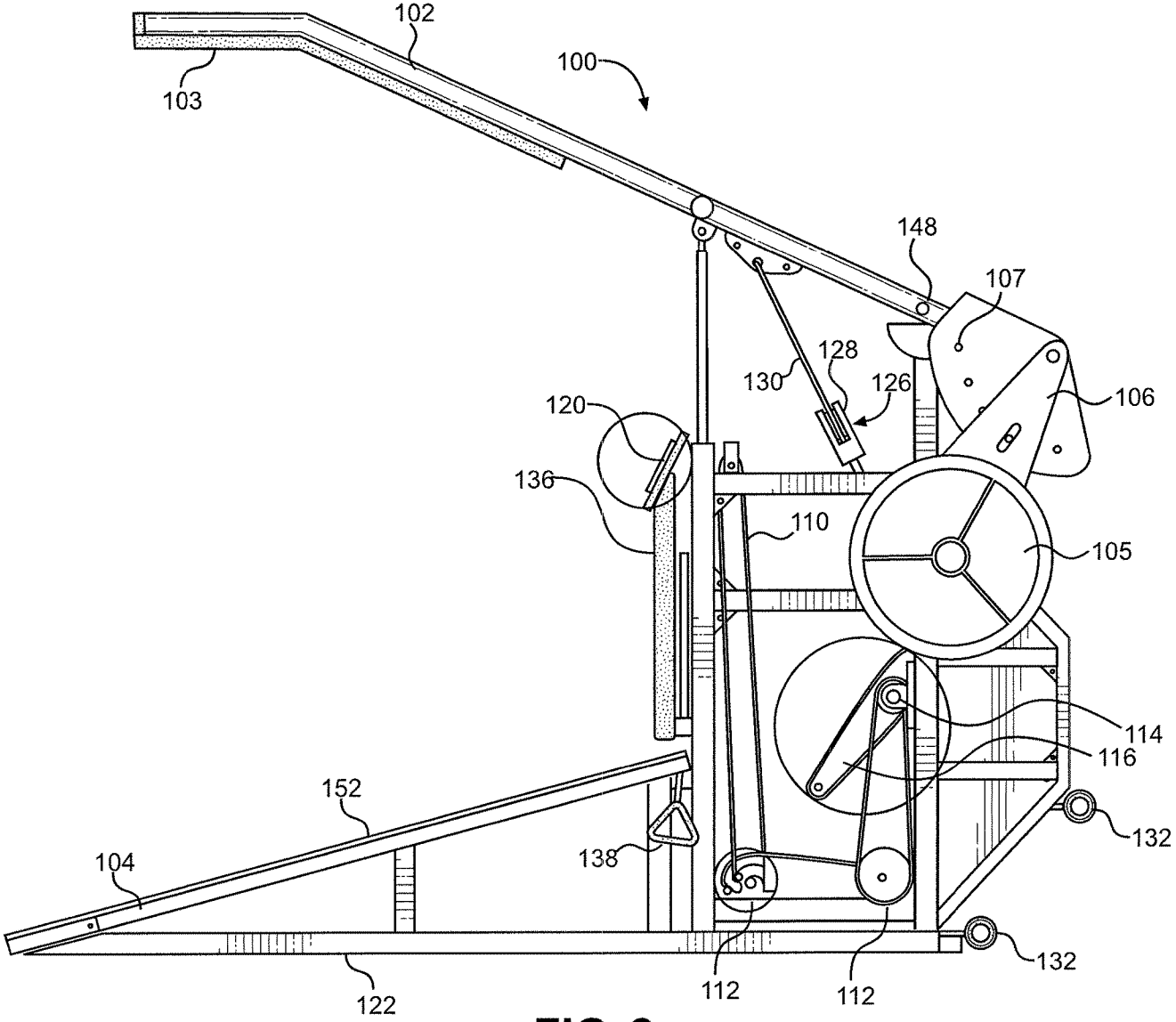
FIG. 2 is a front view of a preferred embodiment of a single-arm workout body conditioning machine with an exposed drive chain system.
Figure 3:
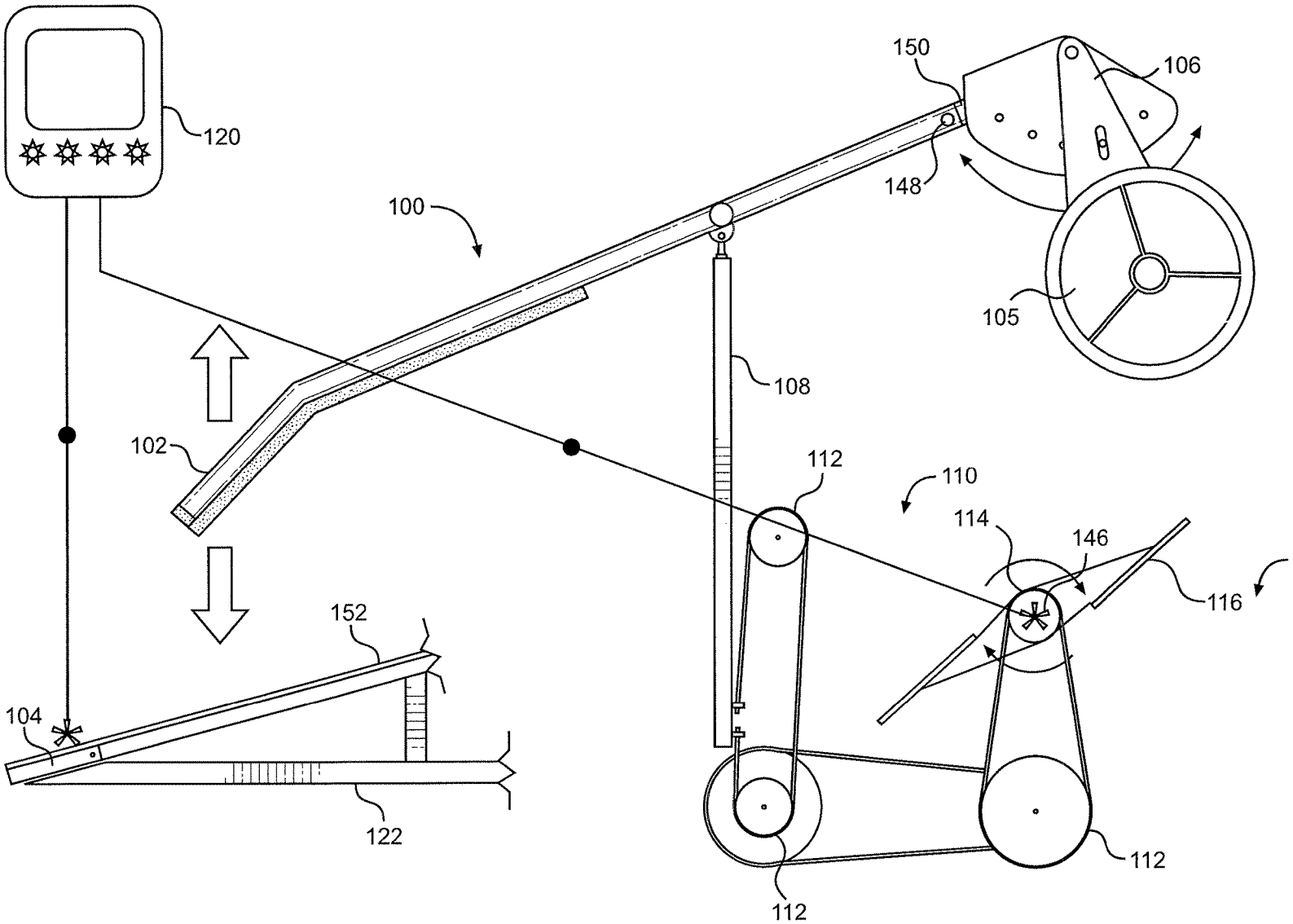
FIG. 3 is a front view of a drive chain system of a preferred embodiment of a single-arm workout body conditioning machine and locations of the electronic encoders on the interacting elements of the machine.

More particularly, as illustrated in FIGS. 1-3, positional selectors 107 position the counterweight arrangement 106 at a particular angle with respect to a counterweight plate 111 attached at an end of arm 102. The position of the counterweight arrangement determines whether the downward force of the weight of weight 105 creates an upward force an arm 102, aiding a user in lifting arm 102, or a downward force on arm 102, causing a user to exert more effort to lift arm 102. As arm 102 is lifted, the corresponding rotation of counterweight arrangement 106 alters the force exerted on arm 102 by counterweight plate 111. For example, when counterweight arrangement 106 is placed in a rear position, the downward force of weight 105 creates a corresponding upward force on arm 102, allowing the user to raise arm 102 with less effort than would otherwise be necessary. Effectively, by raising arm 102, the user is lowering the weight 105. As the arm 102 is raised, the weight 105 approaches its lowest point, and the user is required to exert more force to continue raising the arm 102, since the user is pulling weight 105 horizontally rather than lowering it. If the counterweight arrangement 106 is in a rear position sufficiently close to the central position, as the user lifts arm 102, the user will first lower, then raise weight 105. As a result, the counterweight arrangement 106 initially aids the user in raising arm 102, but works against the user's effort as the user continues raising the arm 102.

By placing the counterweight arrangement 106 in a middle position or a forward position, the user is able to create resistance against raising arm 102 from the time the user begins raising the arm 102. This resistance increases as the user pushes arm 102 further upwards, decreasing the horizontal element of the user's force against weight 105 and increasing the vertical element of that force.

Some preferred embodiments contain more than three positional selectors 107. For example, FIG. 1 illustrates an exemplary preferred embodiment with five positional selectors 107.

The outside of the machine 100 has a protective housing 134 that protects the internal machinery systems, including the drive chain system 110 (shown in FIG. 2), and also protects the user from potential injury. Attached to the exterior of the protective housing 134 is a plurality of wheels 132 that allows the exercise machine 100 to transported. The protective housing 134 is connected to the top of the horizontal base 122.

Attached to the top of the horizontal base 122 is the user platform 104, and the platform 104 is permanently set at an angle of fifteen degrees with respect to horizontal base 122. Affixed atop the user platform 104 is a circuit breaking sensitive rubber mat 152 further discussed below. At the highest point of the user platform 104, there is an attached user cable grip 138. Above the user cable grip 138, a user back support 136 is attached laterally to the drive chain system 110 (shown in FIG. 2) housing 134.

The arm 102 and platform 104 configuration allows for different exercise combinations for both the upper and lower body. Resistance training exercises on the machine 100 will strengthen muscles and connective tissue, develop speed, quicken reaction time, and improve cardiovascular conditioning.

The machine 100 also enables a user to perform explosive exercises, such as plyometrics, safely against the inertia of the adjustable fan 116 (shown in FIG. 2). In the other direction, as the arm 102 returns downwards to the rest position, the user can resist the drop force. Repeatedly initiating these explosive movement patterns with the machine develops athletic conditioning.

Referring now to FIG. 2, the machine 100 is displayed with the arm 102 in its fully extended position. Additionally, in FIG. 2, the external driving chain system housing 134 is removed to reveal the interior components of the machine 100. The bottom of the pull rod 108 is connected to the drive chain system 110 which in turn rotates and initiates the turning of a plurality of sprockets 112 within the drive chain system 110 that causes a plurality of shafts 114 to rotate.

The drive chain and sprocket system 110 have a connected adjustable fan 116 with a resistance mass. The fan 116, a preferred embodiment of which has a resistance mass of twelve pounds, has an inertial force that creates resistance to the upper movement of arm 102. The sprocket sizes, sprocket ratio, and adjustable fan 116 resistance mass can be adjusted to suit the particular user and training goals.

Further, the drive chain and sprocket system 110 includes a directional slip bearing 124 on the shaft 114 of adjustable fan 114. The directional slip bearing 124 rotates in one direction when the arm 102 is lifted up. When shaft's rotation is reversed (i.e., the arm 102 moves downward towards the rest position), the slip bearing 124 disengages the shaft 114 so that the adjustable fan 116 does not spin. In some alternative embodiments, the drive chain system 110 is replaced with a traditional rubber belt system, as commonly used in art.

In some preferred embodiments, an electronic user monitor 120 is attached to the top of the user back support 136. The electronic user monitor 120 displays readings reflecting performance on fundamental exercise movements performed on the machine 100. Specifically, three exemplary measurements are presented.

The first exemplary measurement is the force in Watts from a fan 116 axle encoder 146. The first measurement reflects the force initiated on the fan 116 when the arm 102 is lifted with the fan 116 engaged. This measurement displays a quantitively dynamic strength force and allows for monitoring of concise strength conditioning.

Another measurement is recorded from an arm 102 pivot point encoder 150 located at the axle of the main pivot point of arm 102. This measurement reflects the force and speed that the user is applying to the arm 102, and the arm 102 applies to the user. In particular, the arm 102 force can be read as the degree of movement per second during the drop of the arm 102. The measurement may also read to show a number representative of the force of the arm 102 dropping. For example, in free fall without the adjustable fan 116, the number representative of the force can be "10."

This measurement is useful for explosive and jumping exercises when the users free leave the mat 152 surface of the platform 104. Further, the measurement will give a precise indicator of the speed and agility of the user based on the elapsed time on the mat 152 surface.

Referring now to FIG. 3, an exposed view of the moving components of the machine 100 is displayed. The exposed view demonstrates the location of the electronic encoders. An arm pivot point encoder 150 is located at the arm pivot point 148 near the adjustable counterweight arrangement 106. In a preferred embodiment, the encoder itself may be an RLS™ rotary linear sensor magnetic motion encoder L side ring; the use of similar devices known in the art is fully contemplated herein.

In preferred embodiments, an encoder location is at the adjustable fan 116 axle 146. When the fan 116 is on, one-way rotational data is collected by the fan axle 146 encoder. In a preferred embodiment, the fan axle encoder is an RLS™ encoder-sensor base unit; the use of a similar device configured for integration on electric motors or other devices known in the art for shaft position and velocity measurements is fully contemplated herein. As previously mentioned, this measurement can be a reading of the fan 116 rotational force in watts.

The final exemplary measurement displayed on the electronic user monitor is from the circuit breaking sensitive rubber mat 152. When a user compresses and decompresses on the mat 152, the circuit inside the mat 152 closes and different measurements can be recorded, such as the user's contact time on the mat 152 surface during an exercise. In a preferred embodiment, this reading is the time of the user on the surface in one-hundredths of a second. An example of a suitable wired pressure mat 150 is United Security Products™ (USP) 900 series pressure mat.

Additional embodiments include similar sensors in the base 122, the cable grip 138, the arm 102, the user pad 103, and the various combinations thereof, measuring the user's contact time and, in some embodiments, the amount of pressure on the various components of the machine 100, and enabling the display of the measurements or data derived from the measurements on monitor 120. Measurement and display of other data by means of sensors and monitor 120, including but not limited to the user's heart rate, is fully contemplated herein.

Figure 4:
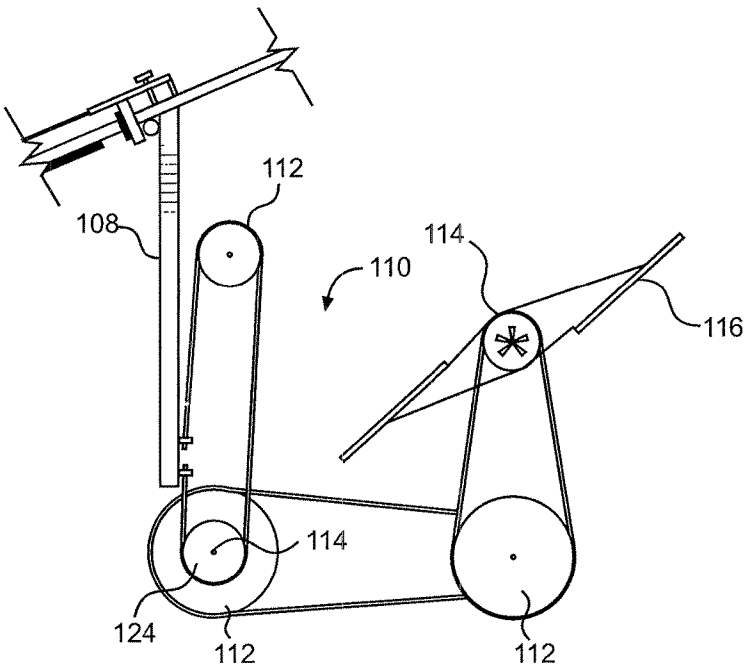
FIG. 4 is a front view of the components of the drive chain system.

An isolated drive chain system 110 is displayed in FIG. 4. More specifically, FIG. 4 demonstrates the interchangeability of sprocket sizes, ratios, and adjustable fan 116 masses. These weights, sizes, and ratios can be changed to adjust speed, resistance and other performance adjusters for the user.

Figure 5:
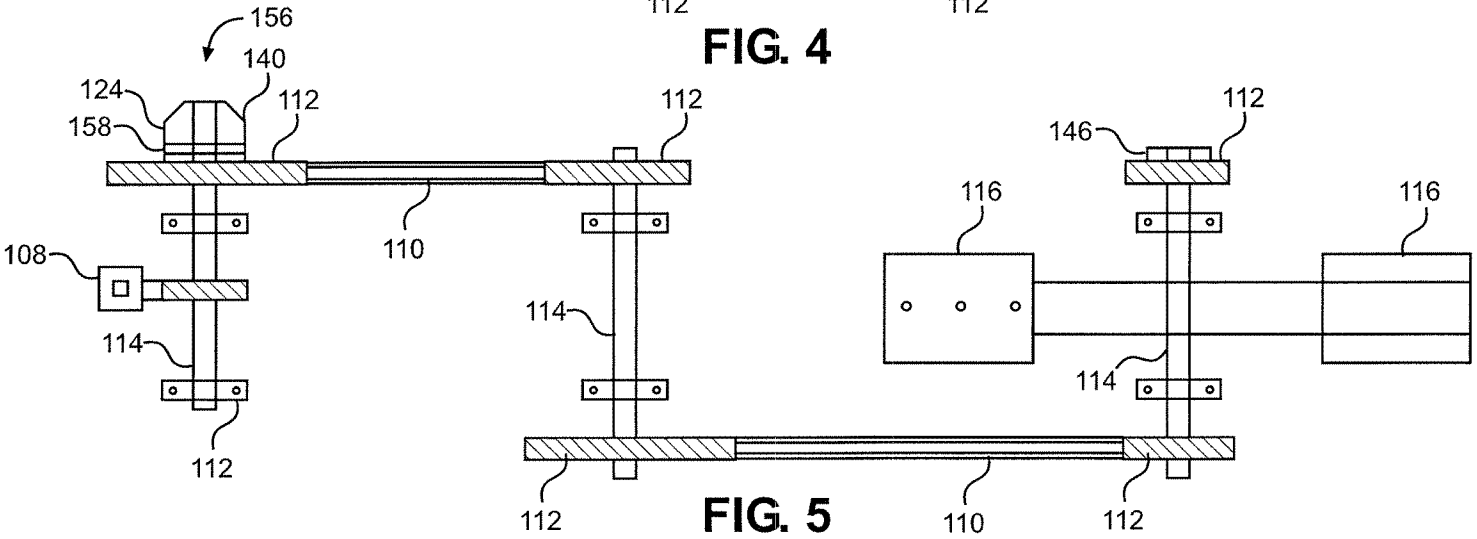
FIG. 5 is a top view of the components of the drive chain system.

Referring now to FIG. 5, a top view of the drive chain system 110 is shown, illustrating the adjustable fan On-Off Locking Hub Assembly 140. The plurality of shafts 114 and plurality of sprockets 112 are shown in greater detail, including attachment points. In a preferred embodiment, bore sizes for the plurality of shafts 114 are one inch (1").

Figure 6:
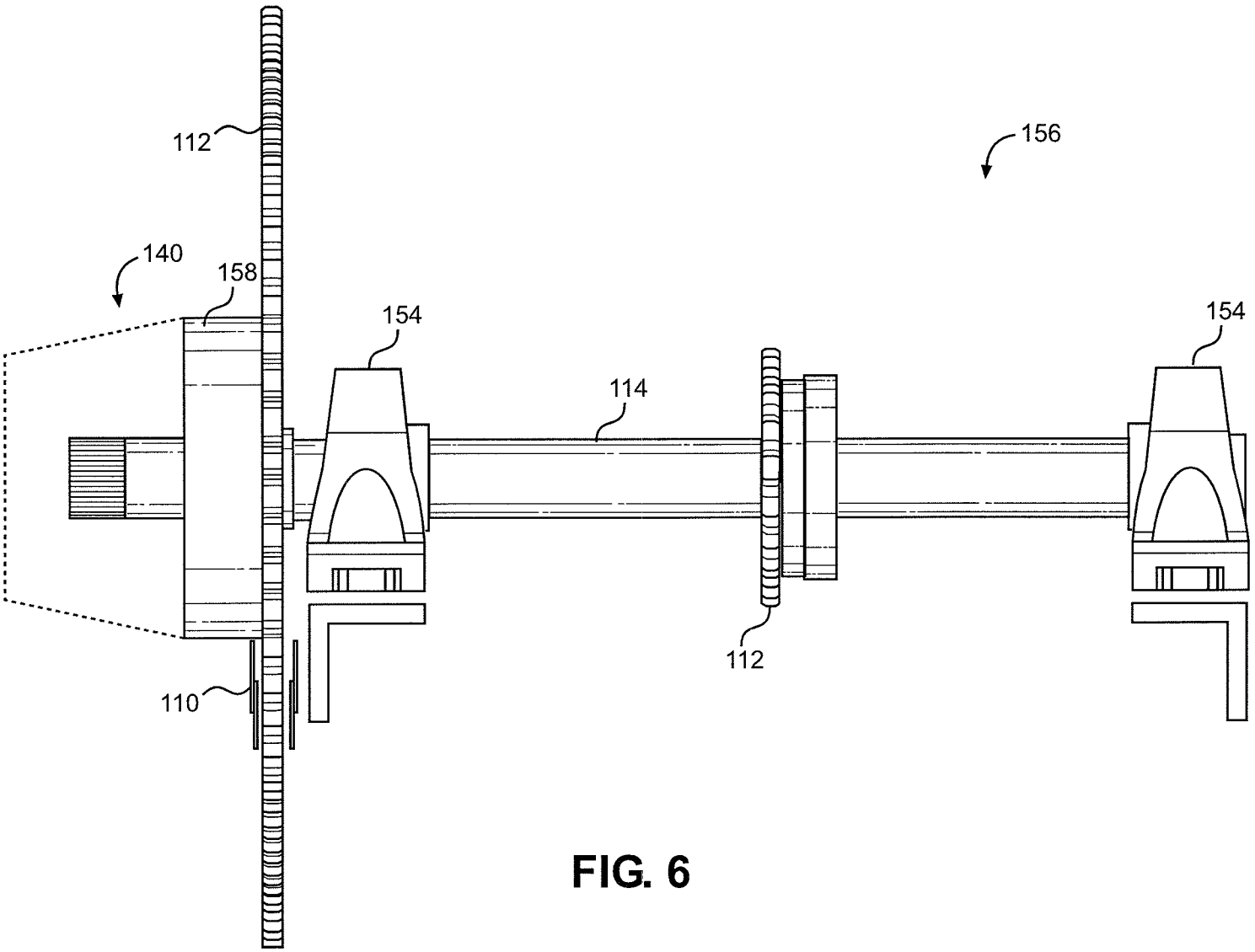
FIG. 6 is a top perspective view of an adjustable fan ON-OFF locking hub assembly of a preferred embodiment of a single-arm workout body conditioning machine.

Moving on to FIG. 6, the adjustable fan On-Off Freewheel Sprocket Shaft Assembly 156 is shown in greater detail in a front perspective view. The locking hub assembly 140 can include a sprocket hub 158. The On-Off feature provides the ability to remove the adjustable fan 116 from the drive chain system 110 and allows the arm 102 to move in free motion without the inertial force of the adjustable fan 116.

A shaft 114 in some embodiments of the Freewheel Sprocket Shaft Assembly 156 includes a plurality of pillow blocks. Additionally, the shaft 114 can consist of mild steel angle brackets configured for mounting within the drive chain system 110 housing.

The use of the terms "a" and "an" and "the" and similar references in the context of describing the invention (especially in the context of the following claims) is to be construed to cover both the singular and the plural unless otherwise indicated herein or clearly contradicted by context. The terms "comprising," "having," "including," and "containing" are to be construed as open-ended terms (i.e., meaning "including, but not limited to,") unless otherwise noted. Recitation of any ranges of values herein is merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Several embodiments of this invention are described herein, including the best mode known to the inventors for carrying out the invention. Variation of those several embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

While there have been shown what are presently considered to be preferred embodiments of the present invention, it will be apparent to those skilled in the art that various changes and modifications can be made herein without departing from the scope and spirit of the invention.

What is claimed is:

1. A single-arm workout body conditioning machine comprising:

a padded arm connected to an adjustable counterweight system;

a pull rod attached to the padded arm and to a drive train system having an adjustable weighted resistance fan;

a recoiler connected to both the padded arm and a drive chain system housing;

a horizontal base connected to the drive chain system housing and to a user platform;

a plurality of wheels attached to the drive chain system housing;

a user back support attached to the drive chain system housing;

a user cable grip attached to the user platform; and a rubber mat mounted on top of the user platform.

2. The machine of claim 1, wherein the drive chain system includes a plurality of sprockets, and a plurality of shafts.

3. The machine of claim 2, wherein the adjustable weighted resistance fan is configured to accept different sprocket sizes and fan masses.

4. The machine of claim 2, wherein the adjustable weighted resistance fan includes a slip bearing configured to disengage a fan shaft to cease the adjustable weighted resistance fan rotation.

5. The machine of claim 1, wherein the recoiler consists of:

a cable attachment; and a housed spring.

6. The machine of claim 1, wherein the rubber mat has an integrated circuit configured to break when compressed and decompressed.

7. The machine of claim 1, wherein the machine further comprises:

a plurality of electronic encoders; and an electronic user monitor;

wherein the electronic user monitor is configured to receive data from the electronic encoders.

8. The machine of claim 7, wherein the data from the plurality of electronic encoders includes force in watts recorded from an encoder on an axel from the adjustable weighted resistance fan.

9. The machine of claim 7, wherein one electronic encoder from the plurality of electronic encoders is at an arm pivot point is a rotary linear sensor magnetic motion encoder.

10. The machine of claim 7, wherein an electronic encoder at a fan axel is an encoder-sensor base unit.

11. The machine of claim 10, wherein the electronic encoder is configured to collect one-way rotational data.

12. The machine of claim 1, wherein the adjustable counterweight system includes a plurality of positional slots configured to adjust the resistance of the padded arm to being raised.

13. The machine of claim 12, wherein the plurality of positional slots includes a first positional selector configured to reduce the downward force of the padded arm.

14. The machine of claim 12, wherein the plurality of positional slots includes a second positional selector configured to allow fine adjustment of the downward force of the padded arm.

15. The machine of claim 12, wherein the plurality of positional slots includes a third positional selector configured to increase the downward force of the padded arm.

16. A single-arm workout body conditioning machine, comprising:

a horizontal base;

a user platform at an angle greater than zero to the horizontal base;

a single arm above the user platform;

an adjustable counterweight arrangement attached to the single arm;

a drive chain system having an adjustable weight fan;

a pull rod having a first end attached to the single arm and a second end attached to the drive chain system;

a recoiler attached to the single arm; and an on-off function, wherein the recoiler is configured to automatically return the single arm to a rest position of the single arm, wherein the adjustable weight fan is configured to create resistance to upward movement of the arm, and wherein the on-off function is configured to switch the single-arm workout body conditioning machine between a first configuration for plyometric exercise and a second configuration for isometric exercise.

17. The single-arm workout body conditioning machine of claim 16, wherein the adjustable counterweight arrangement comprises at least three selectable positions.

18. The single-arm workout body conditioning machine of claim 17, wherein the adjustable counterweight arrangement comprises five selectable positions.

19. The single-arm workout body conditioning machine of claim 16, further comprising at least one electronic encoder configured to collect force resistance data at a predetermined location.

20. The single-arm workout body conditioning machine of claim 19, wherein the at least one electronic encoder comprises a fan encoder located at an axle of the adjustable weight fan, wherein the fan encoder is configured to measure force initiated on the on the adjustable weight fan.

* * * * *